US005997289A

United States Patent [19]

Dover

[11] Patent Number: 5,997,289

[45] Date of Patent: Dec. 7, 1999

[54] ROTARY CALCINER WITH MIXING FLIGHTS

[75] Inventor: Bruce J. Dover, Lockport, N.Y.

[73] Assignee: Harper International Corp., Lancaster, N.Y.

[21] Appl. No.: 09/071,395

[22] Filed: May 1, 1998

[51] Int. Cl.[6] ..... F27B 7/14

[52] U.S. Cl. ..... 432/118; 432/103

[58] Field of Search ..... 432/103, 108, 432/110, 118

[56] References Cited

U.S. PATENT DOCUMENTS

| | | | |
|---|---|---|---|
| 3,556,498 | 1/1971 | Sheahan | 34/108 |
| 3,799,735 | 3/1974 | Jensen | 432/103 |
| 4,259,060 | 3/1981 | Korzeb et al. | 432/118 |
| 4,724,777 | 2/1988 | Reed et al. | 432/118 |
| 4,860,462 | 8/1989 | Gobel | 34/108 |
| 5,083,382 | 1/1992 | Brashears | 432/118 |
| 5,203,693 | 4/1993 | Swanson | 432/118 |
| 5,480,226 | 1/1996 | Milstead | 432/118 |

*Primary Examiner*—Tu Ba Hoang
*Assistant Examiner*—Gregory A. Wilson
*Attorney, Agent, or Firm*—Arthur S. Cookfair; James J. Ralabate

[57] ABSTRACT

A rotary calciner for the treatment such as thermal treatment of particulate solids equipped with riffle flights, each in the form of an inverted V shape. The flights are arranged in at least two rows on the inner circumferential wall of the calciner, the rows being staggered so that the apex of each riffle flight is directly beneath the space between two riffle flights in the row above. The riffle flights provide continuous mixing and improve gas-solid contact curing rotation.

7 Claims, 3 Drawing Sheets

FLOW PATTERN—ONE RIFFLER STAGE

ROTARY CALCINER WITH MIXING FLIGHTS

BACKGROUND OF THE INVENTION

1. Field of the Invention

The present invention relates to a rotary drum for the treatment, such as drying, heating, cooling, calcining and/or mixing of particulate solids.

2. Prior Art

Rotary drums or kilns are commonly employed, either in a batch process or a continuous process for the treatment, for example, drying and/or calcining, of particulate solids, such as sand, gravel, stone, fertilizers, metal oxides, pigments, various powders and the like. Typically, in a batch process, a drum or kiln containing the material to be treated, is horizontally rotated while heat is applied, either directly or indirectly. In a continuous process, an elongated drum or kiln, inclined slightly from the horizontal, is rotated while the particulate solid to be treated is fed into one end, passes through the rotating drum or kiln and the treated material is discharged at the other end. During passage the particulate solid is contacted with gas, for example, heated or reactive gases, to cause the drying, calcining, or other treatment of the solids. As the drum rotates, the bed of particulate solids is carried or dragged upwardly by friction along the inner surface of the drum until the weight of the particles and the steepness of the slope of the particle bed causes it to slide or tumble. This action continues as the particle bed moves forward toward the discharge end. During the process, efficient gas-solid contact is very important. However, when the solid particles have not been closely screened and the bed consists of a range of particle sizes, there is a tendency for size segregation to occur with the coarse particles forming an upper layer in the moving bed and the finer particles forming a lower layer. The result is an uneven treatment or uneven gas-solid contact and the production of non-uniform product.

It is known to improve the mixing and thus the efficiency of gas-solid contact in such processes through the use of lifting flights attached to the inner wall of the rotating drum. As the drum rotates, the lifting flights serve to lift the particles from the moving bed and then allow them to fall as a curtain or shower back to the particle bed. Although gas-solid contact is improved, the repeated lifting and falling of the particles may result in the production of large amounts of fines and dust which may represent a loss of material and, in addition, may coat the larger particles and thereby interfere with the mixing, drying, and/or calcining or other process being applied. Furthermore, the dust and fines may become entrained in the gas stream, resulting in a potential environmental hazard as the dust laden gases re passed to the atmosphere, or an additional step to remove and/or recover the fines from the exiting gas stream.

In other arts, for example, in the sampling art, the need for efficient mixing has led to the use of various methods and devices. One such device is a riffler. A riffler is a device for mixing material, such as a heterogeneous mass of particulate solids to collect a representative sample. The riffler causes the particulate solids being sampled to be split and recombine multiple times (i.e. over multiple stages) to achieve mixing and obtain a representative sample.

U.S. Pat. No. 3,799,735 discloses the treatment, e.g. calcining, of particulate solids in a rotary kiln equipped with trough-shaped conveyor flights extending helically along the inner wall to discharge the particles over the length of the kiln in the form of clouds of substantially parallel curtains.

U.S. Pat. No. 4,319,888 discloses the use of a riffle plate arrangement to intimately mix or blend a stream of char particles with a stream of coal particles prior to burning.

U.S. Pat. No. 4,136,965 discloses a generally triangular mixer block made from a refractory material and designed for use on the inner wall of a generally horizontal rotating drum. A plurality of the mixer blocks may be used in a kiln to provide a uniform product with minimal formation of fines and dust.

U.S. Pat. No. 5,623,883 discloses a kiln for the calcination of powder wherein the inner circumferential wall is equipped with a plurality of protrusions having the shape of a triangular prism.

SUMMARY OF THE INVENTION

It is a primary object of this invention to provide a novel rotary kiln for the treatment of particulate solids wherein, during treatment, the particulate solids are subject to improved mixing through the utilization of novel riffle flights on the interior wall of the kiln.

It is a further object of this invention to provide a novel rotary kiln suitable for various treatments, such as mixing, drying, cooling, heating, and calcining various particulate solids to produce a uniformly treated product, with minimal formation of fines and dusts.

It is a further object to provide a novel rotary kiln for the treatment of particulate solids with gases and characterized by improved gas-solid contact and wherein the loss of solids by entrainment is minimized.

It is a further object to provide a novel batch rotary kiln suitable for the treatment of particulate solids and characterized by improved axial mixing.

It is a still further object to provide a novel continuous rotary kiln suitable for treating particulate solids with improved mixing.

These and other objects are accomplished in accordance with the method of the present invention wherein a bed of particulate solids are tumbled within a rotating kiln and subjected to the mixing action of a series of riffle flights.

The apparatus of this invention comprises a rotary kiln having disposed on at least a portion of the inner circumferential wall, one or more rows of riffle flights, the rows being arranged parallel to the direction of the horizontal axis of the kiln, each individual riffle flight being in the form of an inverted V wherein the apex of the inverted V is oriented in the direction of rotation of the rotary kiln. Preferably the riffle flights comprise at least two rows, with the rows being staggered so that the apex of the riffle flights in each row is positioned directly below the space between two riffle flights in the row above it. Most preferably, there are two rows of riffle flights, each riffle flight having a height of approximately half the inner circumference of the kiln. Riffle flights deployed in this manner on the surface of a rotating kiln will behave like a nearly infinite set of riffler stages. The bed of particulate solids being treated in the kiln will experience one riffler stage per rotation with the result of constant mixing. The rotary kiln may be either batch or continuous and may employ either direct or indirect heating.

Where gas-solid contact is important in the treatment the apparatus may be designed for co-current or counter-current or cross-flow of gases. The latter is the subject of co-pending applications Ser. No. 09/071,393 and Ser. No. 09/071,394, filed of even date herewith. Moreover, the present rotary calciner with riffle flights may be employed to provide improved mixing for particulate solids over a wide range of particle sizes and is especially effective in the treatment of powders.

The depth of the flights, that is, the height of the flights from the inner wall of the kiln, may vary depending on the nature of the materials being treated and their flowability as well as the degree of deep bed mixing required for chemical reaction with the gas phase. For example, in the treatment of a powder, flights which are half as tall as the powder bed is deep will generate an adequate combination of radial (wall-to-center) and axial (end-to-end) mixing.

DETAILED DESCRIPTION OF THE INVENTION

Figure 1:
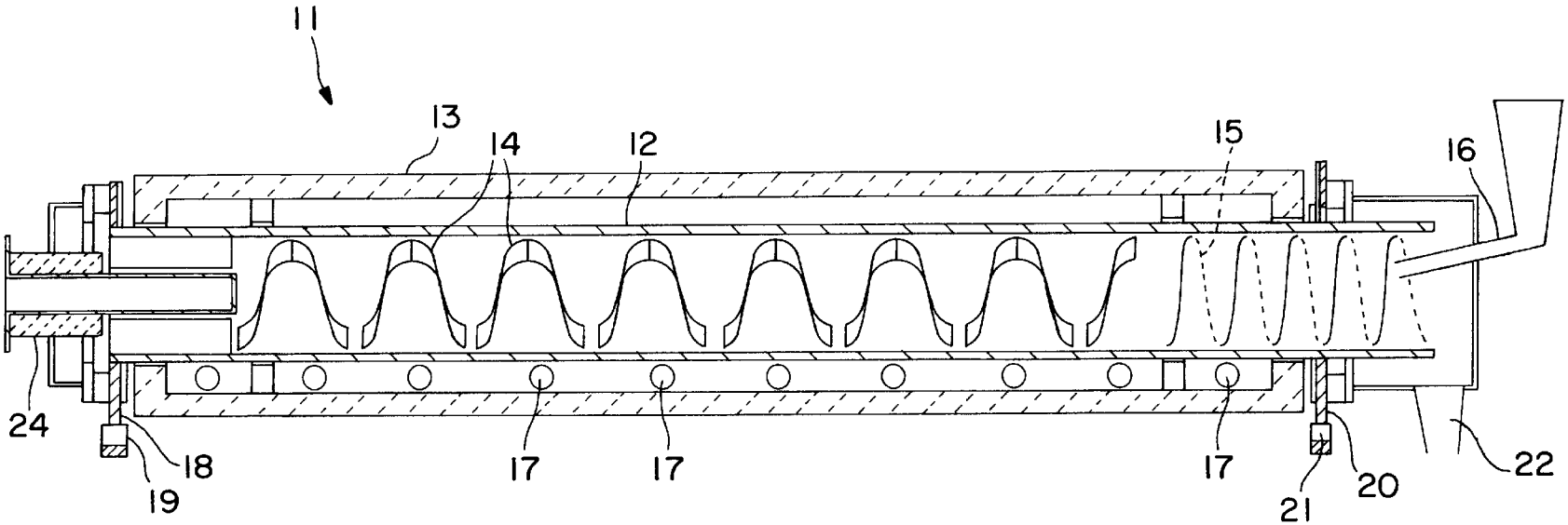
FIG. 1 is a cross-sectional view of a rotary kiln containing riffle flights in accordance with the present invention.

In FIG. 1, a cross-sectional view of an embodiment of a rotary kiln with mixing flights in accordance with the present invention, is illustrated. The embodiment depicted is a batch rotary kiln 11 for thermal treatment of particulate solids comprising a tube 12 within a shell of high temperature insulation 13 and equipped with riffle flights 14 for the mixing of particulate materials during treatment.

In practice, the material to be treated enters the rotating kiln through feed entry 16 and, in a preferred embodiment, is urged farther into the kiln with the aid of spiral flights 15 as the tube rotates. The tube rotates in response to a motor means (not shown) through geared trunion 19 and driven gear 18 at one end and is rotatably supported on the other end by metal tire 20, which rolls on roller trunion 21. During operation, tube 12 rotates in the direction of the apex of the inverted V formed by the riffle flights 14 so that as the particulate material being treated is tumbled within the rotating kiln, it is continually mixed by the "plowing" action of the riffle flights 14 and the consequent splitting and recombining. For thermal treatment, requiring gas-solid contact, gas, which may be pre-heated, enters through gas inlet 24. In the embodiment shown, the kiln is heated by burners 17. However, various other types of heat, such as electric heat, may be used. When treatment is completed, the direction of rotation is reversed causing the spiral flights 15 to urge the treated product in the opposite direction toward product discharge hopper 22. In a preferred embodiment, the rotary calciner is equipped with tilting means (not shown) to take advantage of gravity by tilting the calciner down in the direction away from the feed entry means during loading and downward in the direction of the product discharge hopper 22 when the treated product is removed. The materials of construction may be selected from those suitable materials generally known in the art of kiln manufacture. Thus, for high temperature thermal treatment, tube 12 and riffle are advantageously constructed of a high temperature metal alloy.

Figure 2:
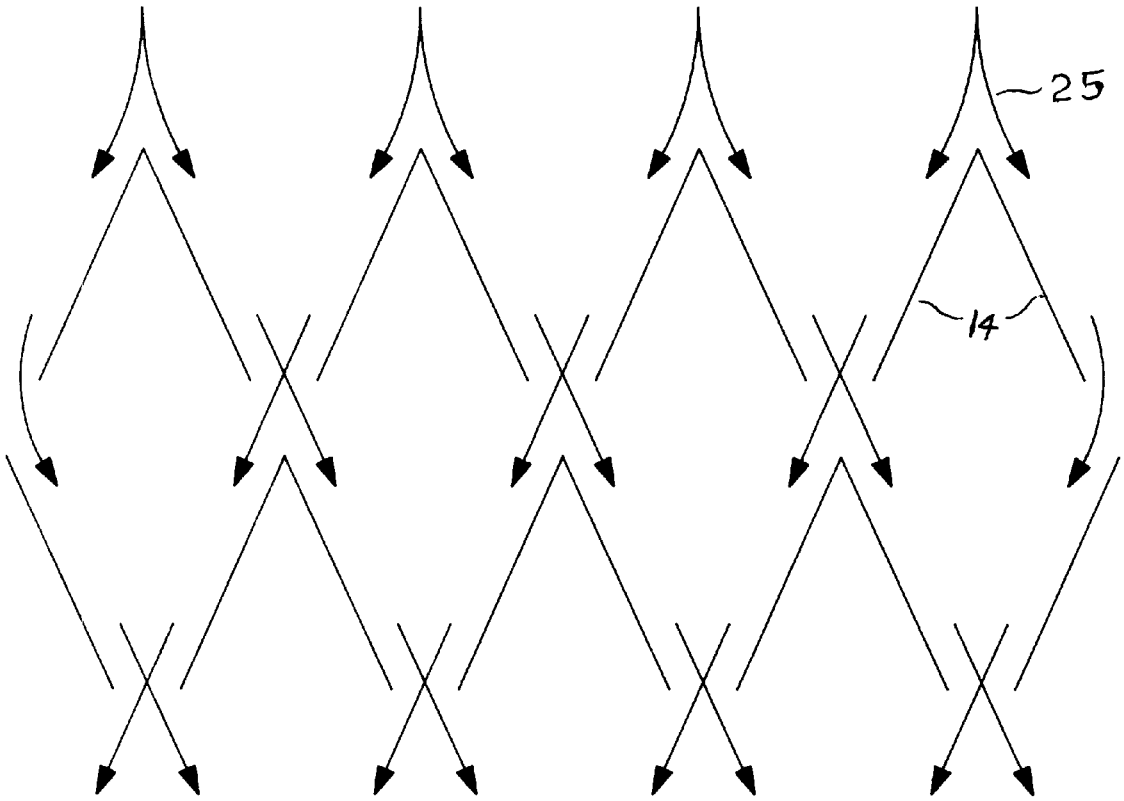
FIG. 2 is a diagrammatic representation of the flow pattern of one riffler stage.
Figure 3:
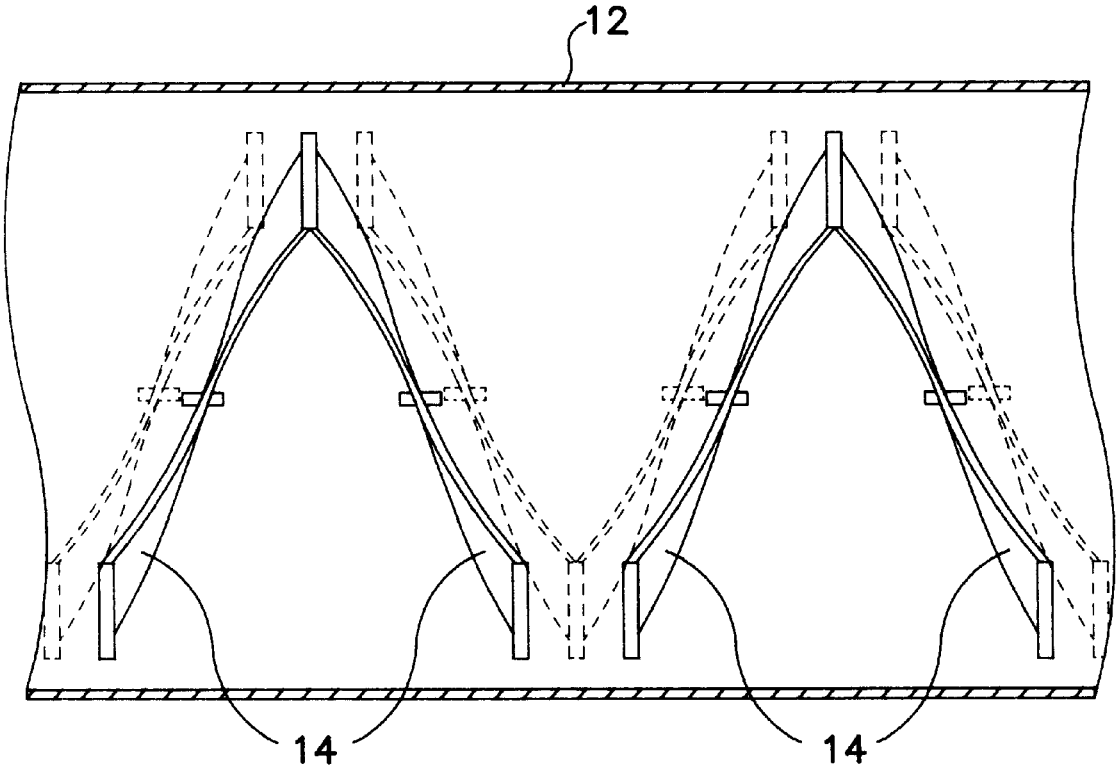
FIG. 3 is a cross-sectional view of a segment of a rotary kiln showing an embodiment of the riffler flights employed.

FIG. 3 depicts a segment of a calciner in accordance with the present invention, in cross-section, with one half of the inner circumferential wall of tube 12 shown with an embodiment of the riffle flights 14 attached thereto. In the embodiment shown, the flights are attached to the wall at their midpoint and at each end. A second set of riffle flights, hidden from view in the cutaway illustrated, is attached to the opposite side of the inner wall of tube 12 (the side not shown in the cutaway). The positioning of the second set of riffle flights is shown in shadow outline form. The positioning of the two sets of riffles flights is staggered so that each apex of one set of riffles flights is in line below the space between two riffle flights preceding it. The two rows or sets of riffle flights, positioned in this manner, form one riffler stage and provide intimate mixing of particulate solids passing through, as depicted diagrammatically in FIG. 2.

FIG. 2 depicts, diagramatically, one riffler stage, consisting of two rows of riffles, shown as inverted V's with the lower row positioned so that the apex of each inverted V is in line below the space between two riffles in the row above it. The arrows 25 represent the flow of particulate solids and the intimate mixing and blending that occurs as they flow through the riffles, splitting and recombining. When a similar geometric arrangement is used for the riffle flights on the inner surface of a rotating tube (as in FIG. 3), the pattern of riffle flights will behave like a nearly infinite set of riffler stages. The particulate solids being mixed pass through one riffler stage per rotation.

Although the invention has been described with reference to certain preferred embodiments, it will be appreciated by those skilled in the art that modifications and variations may be made without departing from the spirit and scope of the invention as defined by the appended claims.

What is claimed is:

1. An apparatus for the treatment of particulate material comprising a horizontally extending rotatable cylinder, at least two rows of riffle flights disposed on at least a portion of the inner circumferential wall of said rotatable cylinder, said rows being parallel to the horizontal longitudinal axis of said rotatable cylinder, each of said riffle flights being in the form of an inverted V-shape and positioned so that the apex of said inverted V-shape is directly in line with a space between two riffle flights in a row above it, said rotatable cylinder having a gas inlet means, a feed entry means, a product discharge means, and means for imparting rotation to said rotatable cylinder in the direction of said apex.

2. An apparatus according to claim 1 having heating means for the thermal treatment of particulate solids during rotation.

3. An apparatus according to claim 2 adapted for continuous treatment of particulate solids having a feed entry means, a product discharge means, a gas inlet means and a means for continuous mixing of said particulate solids by passing therethrough a series of riffler flights arranged to provide the mixing action of one complete riffler stage per rotation.

4. An apparatus according to claim 2 adapted for the batch treatment of particulate solids, having a feed entry means, a product discharge means, a gas inlet means, and a means for tilting said rotatable cylinder along the horizontal longitudinal axis thereof.

5. An apparatus according to claim 2 for the batch treatment of particulate solids having a gas inlet means at one end thereof and a feed entry means and a product discharge means at an other end thereof, means for rotating said rotatable cylinder and means for reversing direction of rotation and a series of spiral flights near said other end for moving said particulate solids into said rotatable cylinder and for moving treated product toward said product discharge means when direction of rotation is reversed.

6. An apparatus according to claim 5 having a tilting means to tilt said rotatable cylinder from its horizontal longitudinal axis.

7. A batch rotary calciner apparatus according to claim 2 for the thermal treatment of particulate materials comprising a horizontally extending cylinder having attached to at least a portion of an inner surface thereof, a plurality of riffle flights, arranged in a pattern to provide one complete riffler stage per rotation when said rotary calciner is rotated about its horizontal longitudinal axis.

* * * * *